United States Patent [19]

Mackey

[11] Patent Number: 4,819,947

[45] Date of Patent: Apr. 11, 1989

[54] AERIAL PROJECTILE GAME APPARATUS

[76] Inventor: Lawton Mackey, 7247 Godfrey Dr., Fay, N.C. 28303

[21] Appl. No.: 151,497

[22] Filed: Feb. 2, 1988

[51] Int. Cl.[4] ..... A63B 65/00; A63B 67/06

[52] U.S. Cl. ..... 273/412; 273/424

[58] Field of Search ..... 273/412, 337, 338, 318, 273/424, 425, 327, 322, 323; 124/5, 6, 7, 79

[56] References Cited

U.S. PATENT DOCUMENTS 1,164,609 12/1915 Darton ..... 124/5

2,690,339 9/1954 Hall ..... 273/327

4,315,629 2/1982 English ..... 273/425

*Primary Examiner*—William H. Grieb

*Attorney, Agent, or Firm*—Fleit, Jacobson, Cohn & Price

[57] ABSTRACT

The present invention generally relates to a game apparatus requiring the use of manual dexterity and skill in projecting an aerial projectile by one player in the game with the other player in the game catching the aerial projectile by the use of a uniquely constructed horseshoe with the players alternately tossing or projecting the aerial projectile and catching it to play a game identified as the hoop-shu game.

3 Claims, 1 Drawing Sheet

AERIAL PROJECTILE GAME APPARATUS

BACKGROUND OF THE INVENTION

1. Field of the Invention

The present invention generally relates to a game apparatus requiring the use of manual dexterity and skill in projecting an aerial projectile by one player in the game with the other player in the game catching the aerial projectile by the use of a uniquely constructed horseshoe with the players alternately tossing or projecting the aerial projectile and catching it to play a game identified as the hoop-shu game.

2. Information Disclosure Statement

Various types of games utilizing horseshoes which are tossed or thrown and various types of games using aerial projectiles which are tossed or thrown are well known. One type of aerial projectile which is well known is that identified by the trademark "FRISBEE". However, the prior art does not disclose the use of an aerial projectile which can be tossed or thrown by one player and caught by a unique horseshoe manipulated by the other player with both players of the game having a catcher in the form of a horseshoe with the players alternately catching and throwing the aerial projectile.

SUMMARY OF THE INVENTION

An object of the present invention is to provide a hoop-shu game apparatus in which two or more players utilize an aerial projectile which is tossed or thrown by one player and caught by another player who uses a catcher in the form of a uniquely constructed horseshoe having a handle projecting from the central portion thereof so the players can ultimately catch and then toss or throw the aerial projectile towards another player.

Another object of the present invention is to provide a hoop-shu game in which the aerial projectile is in the form of a circular disk-like member having an enlarged central aperture so it can be caught by a horseshoe shaped catcher with the aerial projectile preferably being of lightweight plastic material having aerodynamic characteristics which enable it to be tossed or thrown with a spinning action so it will follow a desired path or trajectory.

A further object of the invention is to provide a hoop-shu game apparatus in which the catchers are in the form of plastic horseshoes of generally U-shaped configuration having a handle projecting laterally from the central or bight portion of the horseshoe with the aerial projectile and the catchers being of relatively lightweight inexpensive construction but yet providing a game which will develop and require the use of manual dexterity and also provide exercise and develop eye and hand coordination required of many endeavors.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
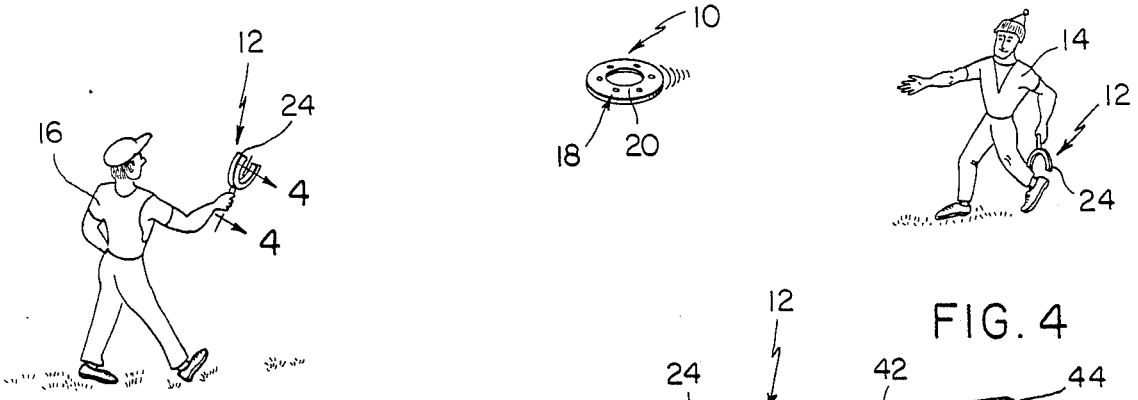
FIG. 1 is a perspective view illustrating two players utilizing the hoop-shu game of the present invention.

Referring now specifically to the drawings, the hoop-shu game apparatus of this invention includes an aerial projectile 10 and a plurality of catchers 12 which are utilized by a first player 14 and a second player 16 positioned in spaced relation at any desired distance so the aerial projectile can be initially launched by the first player 14 by moving the arm and projectile in an arcuate manner to cause the aerial projectile to spin and move in a flight path of desired trajectory. The second player 16 then uses the catcher 12 to catch the aerial projectile and the second player then manually grasps the aerial projectile and launches it back toward the first player who in turn will catch the aerial projectile 10 with the catcher 12 and this cycle of events continues until someone misses or drops the aerial projectile which indicates that points should be scored by the player who does not falter in continuing the cyclic operation of the game.

The aerial projectile 10 is in the form of a generally circular disk 18 of lightweight plastic material having an enlarged central opening 20 which forms an annular disk member in which the radial dimension of the solid portion of the disk between the periphery of the opening 20 and the outer circumference 22 is substantially less than the distance between the two legs 24 of the horseshoe catcher 12 so the two legs of the horseshoe catcher 12 can receive the rim portion of the aerial projectile therein in order to catch the projectile while it is in flight. The central opening 20 of the disk 18 includes a flange and extending outwardly from the flange is an upwardly curved annular portion 26 terminating in a flat portion 28 which continues in a downwardly inclined portion 30 terminating in a generally V-shaped trough which continues as an outwardly extending flange 34 terminating in the downwardly extending edge flange 22 which extends slightly beyond the plane of the edge of the flange which defines the inner opening 20.

The inclined surface 26 may be provided with a plurality of apertures 36 which may be in the form of circular apertures of any desired number, shape and configuration or the inclined surface 26 may be left solid in construction. Also, the inclined surface 30 is provided with a plurality of elongated, narrow slots 38 which are not continuous but are spaced from each other as at 40. The number and width as well as the orientation of the slots 38 may vary or they may be omitted. In any event, the aerial projectile has aerodynamic characteristics which will generally stabilize it in flight depending upon the initial trajectory and spin provided thereto by the players as they launch or toss the projectile toward the other players.

Figure 4:
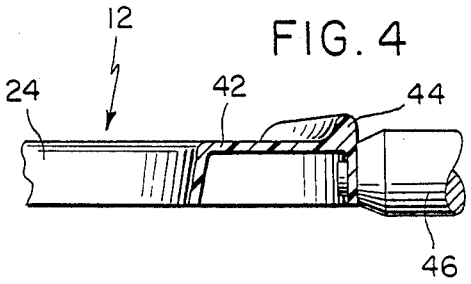
FIG. 4 is a detailed view of the catcher with portions broken away illustrating the cross-sectional configuration thereof and the position of the handle thereon.
Figure 2:
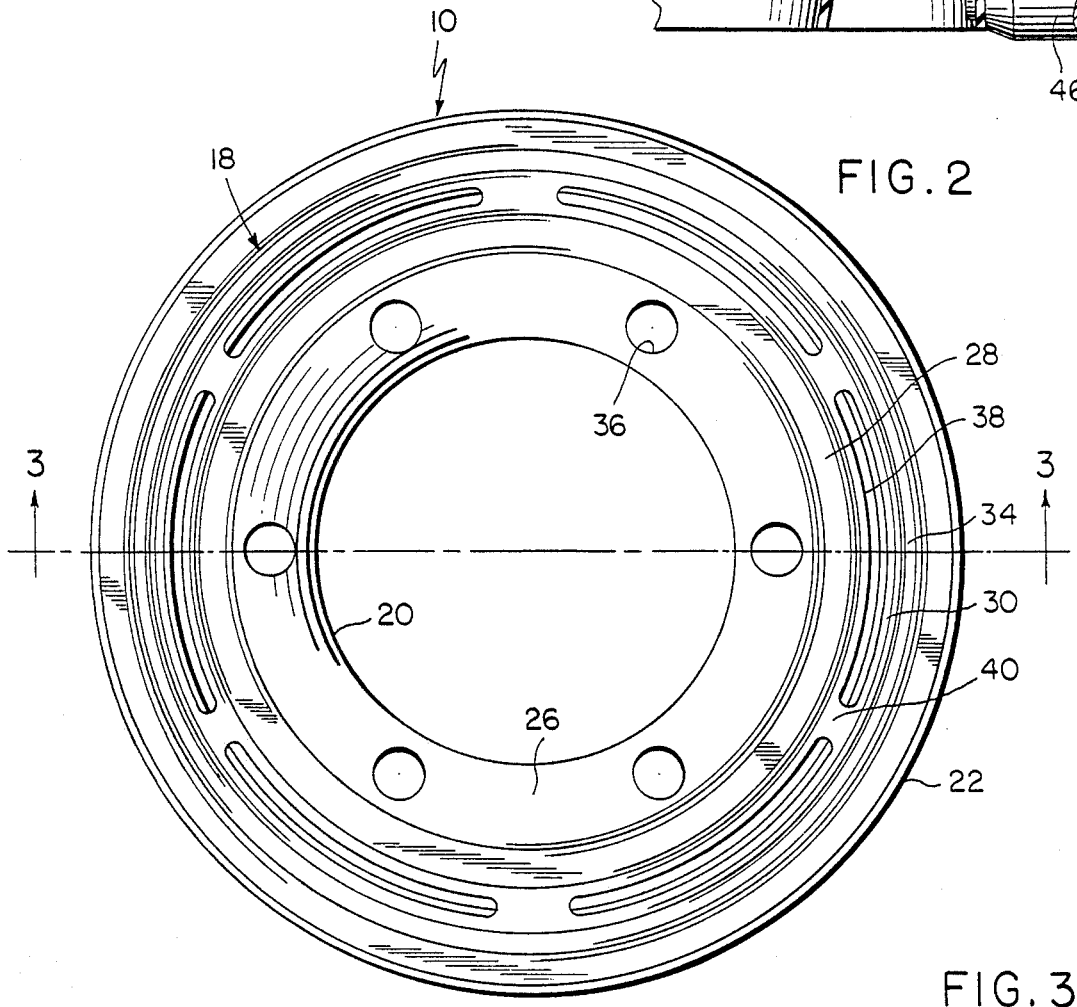
FIG. 2 is a plan view of the aerial projectile.
Figure 3:
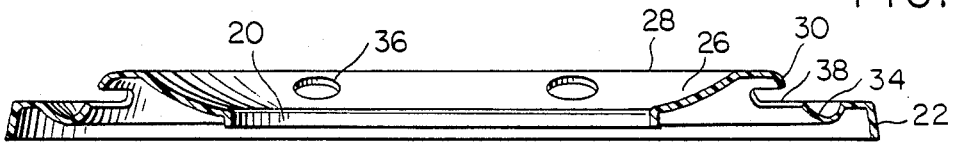
FIG. 3 is a vertical sectional view of the aerial projectile taken along section line 3—3 on FIG. 2.

The catcher 12 is a generally U-shaped horseshoe of plastic construction having a pair of legs 24 and a bight portion 42 of one piece construction therewith with the horseshoe being of lightweight plastic material and of channel-shaped configuration in cross-sectional shape as illustrated in FIG. 4. The bight portion 42 of the horseshoe includes a rib or flange 44 along one surface thereof for reinforcing this area of the horseshoe. An elongated handle 46 is secured to the horseshoe on the outer surface of the bight portion and includes a cylindrical handle that is radially disposed in relation to the outer perimeter of the bight portion 42 of the horseshoe. When the handle 46 is held in the hand as illustrated in FIG. 1, the open end of the horseshoe defined by the spaced legs 24 is capable of manipulation to catch the aerial projectile 10 when it is launched toward one player from the other player.

While the handle 46 has been illustrated as a separate component from the horseshoe, it can be of one piece construction with the horseshoe. The horseshoe and handle may be of the same distinguishable color or they may vary in color with the aerial projectile also being distinguishably colored of any desired color and provided with any desired surface ornamentation. Various color combinations can be used and indicia with distinguishably colored letters, numbers or the like can be provided on the surface of the projectile with the projectile also being capable of having fluorescent characteristics if desired. This enables the projectile to be more easily observed when playing at dusk and also enables easier orientation of the catcher in relation to the projectile since the relative positions of these components can be more easily observed due to their distinguishable coloring and fluorescent characteristics. This game device permits younger children to have a handle which can be easily grasped so they can more easily catch the whirling aerial toy or projectile on the horseshoe rather than with the bare hand. The degree of skill can be varied by varying the aerial characteristics of the projectile and by varying the relative size of the horseshoe in relation to the projectile. Various types of rules to score points when playing games may be developed thereby enhancing the desirable characteristics of the hoop-shu game.

The use of both the aerial projectile and the horseshoe catchers provides the players with a greater sense of competition since standing with the horseshoe catcher in your hand gives a player a greater sense of participation while awaiting the projectile to return as compared to the player standing and waiting for the projectile with nothing in his hand and attempting to catch the projectile with his bare hand. The horseshoe catcher also requires a higher degree of skill as compared to catching the projectile with the bare hand thereby creating better endurance and better coordination as reaction time is reduced to successfully catch the projectile on the horseshoe catcher.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A hoop-shu game apparatus comprising an aerial projectile and horseshoe shaped catchers to be utilized by opposing players with each player having a catcher for catching the projectile launched by hand in a predetermined trajectory by an opposing player, said aerial projectile being of annular configuration and provided with an enlarged center opening and having aerodynamic characteristics to enable it to follow a generally stable flight path when thrown by hand, each of said catchers including a generally U-shaped horseshoe having spaced legs terminating in free ends defining an opening to receive the annular portion of the projectile, the distance between the legs being substantially greater than the radial dimension of the annular portion of the projectile and a handle on the horseshoe to enable the players to manipulate the catcher in a manner to catch the aerial projectile while in flight, said handle extending radially outwardly from the bight portion of the horseshoe catcher with the handle being in substantially the same plane as the horseshoe and in the form of an elongated rigid cylindrical member.

2. The structure as defined in claim 1 wherein said aerial projectile includes apertures in the body portion thereof to enable passage of air and to enhance the flight characteristics thereof, and surface ornamentation on said aerial projectile with the aerial projectile and horseshoes being constructed of distinguishably colored plastic material of lightweight construction to facilitate the manufacture of the game components in a manner to retain the cost at a minimum.

3. A game device comprising a catcher for catching an aerial projectile, said catcher being of generally U-shaped configuration and having a pair of generally parallel legs terminating in spaced free ends to define an outwardly opening throat to receive the aerial projectile, said catcher being constructed of plastic material and being channel-shaped in cross-sectional configuration and a handle projecting radially outwardly from the bight portion of the catcher in generally parallel relation to the legs and oriented centrally of the planes in which the legs are disposed to facilitate balance of the catcher and manipulation thereof to manually catch an aerial projectile which has been launched in the direction of a person having control of the catcher, said bight portion of the catcher including an upwardly projecting flange for reinforcing the horseshoe, said flange being disposed at the inner end of said handle and extending to an elevation above the top surface of the handle.

* * * * *